US010524081B2

(12) United States Patent
Murayama et al.

(10) Patent No.: US 10,524,081 B2
(45) Date of Patent: Dec. 31, 2019

(54) SOUND PROCESSING DEVICE, SOUND PROCESSING METHOD, AND SOUND PROCESSING PROGRAM

(71) Applicant: CEAR, INC., Tokyo (JP)

(72) Inventors: Yoshitaka Murayama, Yashio (JP); Akira Gotoh, Yokosuka (JP)

(73) Assignee: CEAR, INC., Tokyo (JP)

( * ) Notice: Subject to any disclaimer, the term of this patent is extended or adjusted under 35 U.S.C. 154(b) by 51 days.

(21) Appl. No.: 15/053,097

(22) Filed: Feb. 25, 2016

(65) Prior Publication Data

US 2016/0286331 A1 Sep. 29, 2016

Related U.S. Application Data

(63) Continuation of application No. PCT/JP2013/073255, filed on Aug. 30, 2013.

(51) Int. Cl.

*H04S 7/00* (2006.01)
*H04S 3/02* (2006.01)
*H04S 5/00* (2006.01)

(52) U.S. Cl.

CPC ..... *H04S 7/307* (2013.01); *H04S 3/02* (2013.01); *H04S 7/304* (2013.01); *H04S 7/305* (2013.01);

(Continued)

(58) Field of Classification Search

CPC . H04S 7/307; H04S 3/02; H04S 7/304; H04S 5/005; H04S 2400/11;

(Continued)

(56) References Cited

U.S. PATENT DOCUMENTS 6,259,795 B1 7/2001 McGrath
2010/0054483 A1* 3/2010 Mizuno ..... H04S 7/302 381/17

(Continued)

FOREIGN PATENT DOCUMENTS

CN 1949940 A 4/2007
CN 101529930 A 9/2009

(Continued)

OTHER PUBLICATIONS

Office Action dated Feb. 21, 2017 issued in corresponding Chinese Application No. 201380079120.9.

(Continued)

*Primary Examiner* — Paul Kim
*Assistant Examiner* — Douglas J Suthers
(74) *Attorney, Agent, or Firm* — Nath, Goldberg & Meyer; Jerald L. Meyer; Stanley N. Protigal

(57) ABSTRACT

A sound processing device includes an equalizer that tunes the frequency characteristic so that a frequency characteristic of the sound wave listened in a second environment replicates the frequency characteristic of a sound wave listened in a first environment. A plurality of the equalizers is provided corresponding to a plurality of sound image signals that has respective sound images to be localized in different directions. In addition, the equalizer performs a unique frequency characteristic changing process to the corresponding sound image signal. Each equalizer has a transfer function that cancels the unique change to the frequency characteristic caused in accordance with the sound localization direction of the sound image signal.

17 Claims, 6 Drawing Sheets

(52) U.S. Cl.
CPC ..... *H04S 5/005* (2013.01); *H04S 2400/11* (2013.01); *H04S 2400/13* (2013.01); *H04S 2420/01* (2013.01); *H04S 2420/07* (2013.01)

(58) Field of Classification Search
CPC ..... H04S 2400/13; H04S 2420/01; H04S 2420/07; H04S 7/305
USPC ..... 381/101, 303, 310
See application file for complete search history.

(56) References Cited

U.S. PATENT DOCUMENTS

| | | | | |
|---|---|---|---|---|
| 2011/0116638 | A1* | 5/2011 | Son | H04S 3/008 381/1 |
| 2013/0170649 | A1* | 7/2013 | Lee | H04S 5/005 381/18 |

FOREIGN PATENT DOCUMENTS

| | | | |
|---|---|---|---|
| CN | 102711032 | A | 10/2012 |
| JP | 08182100 | A | 7/1996 |
| JP | 2001224100 | A | 8/2001 |
| JP | 2001346299 | A | 12/2001 |
| JP | 201021982 | A | 1/2010 |
| WO | 2006009004 | A1 | 1/2006 |
| WO | 2013/077226 | A1 | 5/2013 |
| WO | 2013/108200 | A1 | 7/2013 |
| WO | 2013105413 | A1 | 7/2013 |
| WO | 2013/111348 | A1 | 8/2013 |

OTHER PUBLICATIONS

Office Action dated Mar. 1, 2017 issued in corresponding European Application No. 13892221.6.
International Search Report dated Nov. 21, 2013 corresponding to International application No. PCT/JP2013/073255.

* cited by examiner

IMPULSE RESPONSE IN REPRODUCTION SETTING FOR SOUND LOCALIZATION AT LEFT SPEAKER POSITION

IMPULSE RESPONSE IN REPRODUCTION SETTING FOR SOUND LOCALIZATION AT CENTER

SOUND PROCESSING DEVICE, SOUND PROCESSING METHOD, AND SOUND PROCESSING PROGRAM

TECHNICAL FIELD

The present disclosure relates to sound processing technologies that change sound signals which have been tuned for a predetermined environment to sound signals for other environments.

BACKGROUND ART

A listener detects the time difference, sound pressure difference, and echo, etc., of sound waves reaching right and left ears, and perceives a sound image in that direction. When a head-related transfer function from a sound source to both ears is well tuned with the original sound source in a reproducing sound field, the listener is capable of perceiving a sound image replicating the original sound field in the reproducing sound field.

In addition, sound waves have a unique change in sound pressure level to each frequency until reaching an ear drum through a space, a head, and an ear. The unique change in sound pressure level to the frequency is called a transfer characteristic. When the head-related transfer function is well tuned between the original sound field and the listening sound field, the listener is capable of listening the same tone as that of the original sound by the similar transfer characteristic.

In most cases, however, the head-related transfer function differs between the original sound field and the listening sound field. For example, it is difficult to reproduce the sound field space of an actual or virtual concert hall at a living room. Hence, a positional relationship between a speaker in the listening space and a sound receiving point therein relative to a positional relationship between the sound source in the original sound field space and the sound receiving point therein differs from each other in distance and angle, and thus the head-related transfer function is not tuned well. Hence, the listener perceives the sound image position and the tone that are different from those of the original sound. This is also caused by a difference in number of sound sources between the original sound field space and the listening space. That is, this is also caused by a sound localization method carried out through a surround output scheme by stereo speakers, etc.

Hence, in general, in a recording studio or a mixing studio, sound processing is performed on recorded or artificially created sound signals so as to replicate the sound effect of the original sound under a predetermined listening environment. In the case of, for example, a studio, a mixer engineer expects certain speaker arrangement and sound receiving point, intentionally corrects the time difference and sound pressure difference of sound signals in multiple channels output by respective speakers so as to cause the listener to perceive a sound image replicating the sound source position of original sounds, and changes the sound pressure level for each frequency so as to be tuned with the tone of the original sounds.

International Telecommunication Union-Radio sector (ITU-R) recommends a specific arrangement of 5.1-ch. speakers, etc., and for example, THX defines standards, such as the speaker arrangement in a movie theater, the volume of sound, and the scale of the interior of the movie theater. When the mixer engineer and the listener follow such recommendation and standards, even if the listening environment differs from the original sound field, when the sound signals reach the ear drums of the listener under the listening environment, the sound source position of the original sound and the tone thereof are well replicated.

Although it becomes unnecessary to tune the listening environment with the original sound field, however, a favorable setting of a listening room in accordance with the recommendation and standards is not easy. Hence, respective manufacturers add, to their respective reproducing devices, functions of re-tuning sound signals in accordance with the listening environment produced by the reproducing device, and of replicating the original sound field in a listening room.

For example, there is a known scheme of adding a manual direction tuning function and an equalizer to a reproducing device, enabling a listener to input numerical values for reproducing characteristics, such as the phase characteristic, the frequency characteristic, and the echo characteristic, thereby changing the time difference, sound pressure difference, and frequency characteristic of sound signals in accordance with the input values (see, for example, Patent Document 1).

In addition, there is also a known scheme of mapping the frequency characteristics, etc., of the original sound field beforehand, collecting sound wave signals at a listening position via a microphone, checking the mapping data with the collected data, and tuning the time difference, sound pressure difference, and sound pressure level for each frequency of sound signals for each speaker (see, for example, Patent Document 2).

RELATED TECHNICAL DOCUMENTS

Patent Documents

Patent Document 1: JP 2001-224100 A
Patent Document 2: WO 2006/009004 A

SUMMARY OF INVENTION

Technical Problem

According to the scheme disclosed in Patent Document 1, however, it is necessary for the user to image the original sound field, expect the phase characteristic, the frequency characteristic, and the echo characteristic, etc., from the original sound field, and input the numerical values of the expected characteristics to the reproducing device. According to such a user operation, a work to produce the listening sound field that replicates the original sound field is quite time-consuming and difficult, and thus it is almost impossible to tune the head-related transfer function of the listening environment with that of the original sound field.

According to the scheme disclosed in Patent Document 2, although a user does not need a time-consuming work, the user still needs a work for accomplishing the replicated original sound field, and costs are quite high since this scheme needs a microphone, a large amount of mapping data, and a highly sophisticated arithmetic processing unit that calculates a correction coefficient for sound signals based on the mapping data and the collected data.

In addition, those schemes perform a uniform equalizer process on sound signals. The sound signals are obtained by down-mixing performed on a sound image signal that have a sound image localized in each direction, and contains sound image components in respective directions. According to the uniform equalizer process, although tones are reproduced as if the listener listens sounds in a sound field space that replicates the listening field in accordance with the recommendation and standards for a sound image from a specific direction, it has been confirmed that a reproduction of tones for other sound images is inadequate. The reproduction of tones may become inadequate for all sound images in some cases.

The present disclosure has been made in order to address the technical problems of the above-explained conventional technologies, and an objective of the present disclosure is to provide a sound processing device, a sound processing method, and a sound processing program which excellently tune tones of sounds to be listened under different environments.

Solution to Problem

The inventors of the present disclosure keenly made studies, identified a cause of inadequate tone reproduction due to a uniform equalizer process on sound signals, and found that the transfer characteristic of a sound wave differs in accordance with a sound localization direction. It becomes clear that, according to the uniform equalizer process, although the frequency change of sound waves localized in a given direction may be incidentally cancelled, it is not tuned with the frequency change of sound waves localized in other directions, and thus the reproduced tone sound image by sound image differs from the reproduced tone in an expected environment like an original sound field.

Therefore, in order to accomplish the above objective, a sound processing device according to an aspect of the present disclosure corrects a difference in tone listened in different environments, and includes:

an equalizer tuning a frequency characteristic so that a frequency characteristic of a sound wave listened in a second environment replicates a frequency characteristic of the same sound wave listened in a first environment, in which a plurality of the equalizers is provided corresponding to a plurality of sound image signals that has respective sound images to be localized in different directions, and performs a unique frequency characteristic changing process to the corresponding sound image signal.

Each of the equalizers may have a unique transfer function to each sound localization direction, and applies the unique transfer function to the corresponding sound image signal.

The transfer function of the equalizer may be based on a difference between channels created to cause the sound image of the corresponding sound image signal to be localized.

The difference between the channels may be an amplitude difference, a time difference or both applied between the channels in accordance with the sound localization direction at the time of signal outputting.

The transfer function of the equalizer may be based on each head-related transfer function of the sound wave reaching each ear in the first environment and in the second environment.

The above sound processing device may further include a sound localization setting unit giving the difference between the channels to cause the sound image of the sound image signal to be localized, in which the transfer function of the equalizer may be based on the difference given by the sound localization setting unit.

The above sound processing device may further include a sound source separating unit separating each sound image component from a sound signal containing a plurality of sound image components with different sound localization directions to generate each of the sound image signals, in which the equalizer performs the unique frequency characteristic changing process to the sound image signal generated by the sound source separating unit.

A plurality of the sound source separating units may be provided corresponding to each of the sound image components;

each of the sound source separating unit may include:

- a filter giving a specific time of delay to a first channel of the sound signal, and tuning the corresponding sound image components to have a same amplitude and a same phase;
- a coefficient determining circuit multiplying the first channel of the sound signal by a coefficient m to generate an error signal between the channels, and calculating a recurrence formula of the coefficient m containing the error signal; and
- a synthesizing circuit multiplying the sound signal by the coefficient m.

In addition, in order to accomplish the above objective, a sound processing method according to another aspect of the present disclosure is to correct a difference in tone listened in different environments, and includes a tuning step of tuning a frequency characteristic so that a frequency characteristic of a sound wave listened in a second environment replicates a frequency characteristic of the same sound wave listened in a first environment, in which the tuning step is performed uniquely to a plurality of sound image signals that has respective sound images to be localized in different directions, and a unique frequency characteristic changing process to the corresponding sound image signal is performed thereon.

Still further, a sound processing program according to the other aspect of the present disclosure causes a computer to realize a function of correcting a difference in tone listened in different environments, and the program further causes the computer to function as:

an equalizer tuning a frequency characteristic so that a frequency characteristic of a sound wave listened in a second environment replicates a frequency characteristic of the same sound wave listened in a first environment, in which a plurality of the equalizers is provided corresponding to a plurality of sound image signals that has respective sound images to be localized in different directions, and performs a unique frequency characteristic changing process to the corresponding sound image signal.

Advantageous Effects of Invention

According to the present disclosure, the unique frequency characteristic to each sound image component in sound signals is tuned. This enables an individual action to a change in unique transfer characteristic to each sound image component, and thus the tone of each sound image component can be reproduced excellently.

DESCRIPTION OF EMBODIMENTS

[First Embodiment]

Figure 1:
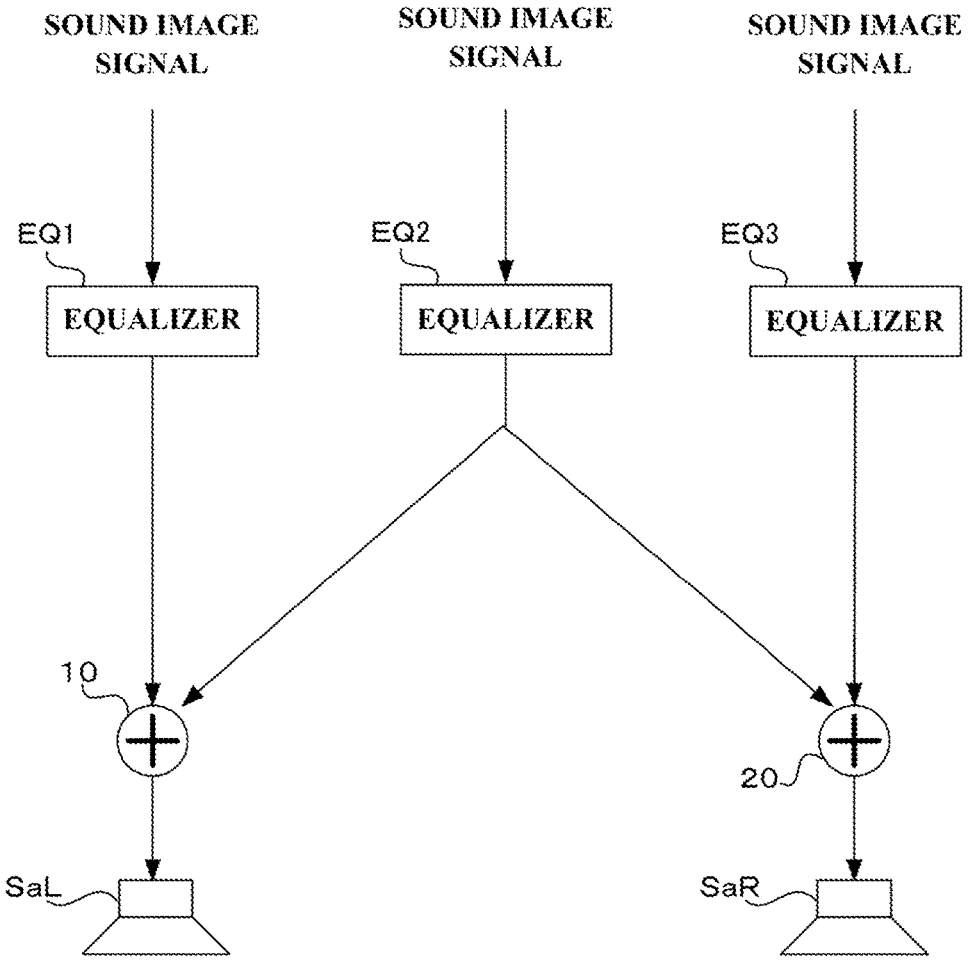
FIG. 1 is a block diagram illustrating a structure of a sound processing device according to a first embodiment.

A sound processing device according to a first embodiment will be explained in detail with reference to the accompanying figures. As illustrated in FIG. 1, the sound processing device includes three types of equalizers EQ1, EQ2, and EQ3 at the forward stage, includes adders 10, 20 for two channels at the subsequent stage, and is connected to a left speaker SaL and a right speaker SaR. The forward stage is the distant side from the left and right speakers SaL and SaR from the standpoint of a circuit. The left and right speakers SaL and SaR are each a vibration source that generates sound waves in accordance with signals. The left and right speakers SaL, SaR reproduce, i.e., generate sound waves, those sound waves reach both ears of a listener, and thus the listener perceives a sound image.

Each equalizer EQ1, EQ2, and EQ3 has each corresponding sound image signal input therein. Each equalizer EQ1, EQ2, and EQ3 has a unique transfer function to each circuit, and applies this transfer function to the input signal. In this case, a sound signal is obtained by mixing replicative sound image components in respective sound localization directions produced when reproduced by surround speakers, is formed by channel signals corresponding to the respective speakers SaL and SaR, and contains each sound image signal. The sound image signal is a sound image component of the sound signal. That is, the sound signal is subjected to a sound source separation to the sound image signal, and the corresponding sound image signal is input to the corresponding equalizer EQi (where i=1, 2, and 3). The sound image signal may be distinguishably prepared beforehand without being mixed with the sound signal.

The equalizers EQ1, EQ2, and EQ3 are each, for example, an FIR filter or an IIR filter. The three types of equalizers EQ1 include the equalizer EQ2 corresponding to the sound image signal that has a sound image localized at the center, the Equalizer EQ1 corresponding to the sound image signal that has a sound image localized at the front area of the left speaker SaL, and the equalizer EQ3 corresponding to the sound image signal that has a sound signal localized at the front area of the right speaker SaR.

The adder 10 generates a left-channel sound signal to be output by the left speaker SaL. The adder 10 adds the sound image signal through the equalizer EQ1 to the sound image signal through the equalizer EQ2. The adder 20 generates a right-channel sound signal to be output by the right speaker SaR. This adder 20 adds the sound image signal through the equalizer EQ2 to the sound image signal through the Equalizer EQ3.

The sound localization is defined based on the sound pressure difference and time difference of sound waves reaching a sound receiving point from the right and left speakers SaR and SaL. In this embodiment, the sound image signal that has the sound image to be localized at the front side of the left speaker SaL is output by only the left speaker SaL, and the sound pressure from the right speaker SaR is set to be zero. Hence, the sound image is substantially localized. The sound image signal that has the sound image to be localized at the front side of the right speaker SaR is output by only the right speaker SaR, and the sound pressure from the left speaker SaL is set to be zero. Hence, the sound image is substantially localized.

According to such a sound processing device, the corresponding sound image signal is input to the corresponding equalizer EQi, and the unique transfer function is applied to the sound image signal. Accordingly, a tone at the sound receiving point in an actual listening environment that is a second environment is caused to be tuned with the tone at the sound receiving point in an expected listening environment that is a first environment.

The term actual listening environment is a listening environment that has a positional relationship between the speaker that actually reproduces the sound signal and the sound receiving point. The expected listening environment is a desired environment by the user, and is an environment that has a positional relationship between the speaker in an original sound field, a reference environment defined by ITU-R, a recommended environment by THX, or an environment expected by a creator like a mixer engineer, and, the sound receiving point.

Figure 2:
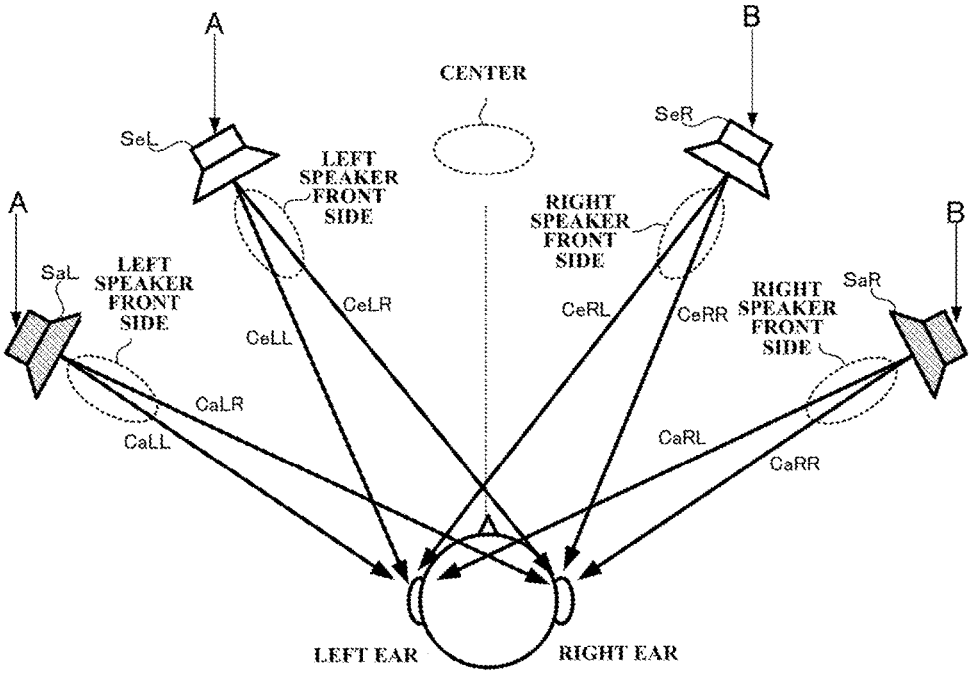
FIG. 2 is an exemplary diagram illustrating an expected listening environment, an actual listening environment, and each sound localization direction according to the first embodiment.

The transfer function of the equalizer EQi will be explained with reference to FIG. 2 based on the theory of the sound processing device. In the expected listening environment, it is assumed that a transfer function of a frequency change given by a transfer path from a left speaker SeL to the left ear is CeLL, a transfer function of a frequency change given by a transfer path from the left speaker SeL to the right ear is CeLR, a transfer function of a frequency change given by a transfer path from a right speaker SeR to the left ear is CeRL, and a transfer function of a frequency change given by a transfer path from the right speaker SeR to the right ear is CeRR. In addition, it is assumed that a sound image signal A is output by the left speaker SeL, while a sound image signal B is output by the right speaker SeR.

At this time, a sound wave signal to be listened by the left ear of the user at the sound receiving point becomes a sound wave signal DeL as expressed by the following formula (1), while a sound wave signal to be listened by the right ear of the user at the sound receiving point becomes a sound wave signal DeR as expressed by the following formula (2). The following formulae (1), (2) are based on an expectation that the output sound by the left speaker SeL also reaches the right ear, while the output sound by the right speaker SeR also reaches the left ear.

$$DeL=CeLL\cdot A+CeRL\cdot B \quad (1)$$

$$DeR=CeLR\cdot A+CeRR\cdot B \quad (2)$$

In addition, it is assumed that, in the actual listening environment, a transfer function of a frequency change given by a transfer path from a left speaker SaL to the left ear is CaLL, a transfer function of a frequency change given by a transfer path from the left speaker SaL to the right ear is CaLR, a transfer function of a frequency change given by a transfer path from a right speaker SaR to the left ear is CaRL, and a transfer function of a frequency change given by a transfer path from the right speaker SaR to the right ear is CaRR. Still further, it is assumed that the sound image signal A is output by the left speaker SaL, while the sound image signal B is output by the right speaker SaR.

At this time, a sound wave signal to be listened by the left ear of the user at the sound receiving point becomes a sound wave signal DaL as expressed by the following formula (3), while a sound wave signal to be listened by the right ear of the user at the sound receiving point becomes a sound wave signal DaR as expressed by the following formula (4).

$$DaL=CaLL\cdot A+CaRL\cdot B \quad (3)$$

$$DaR=CaLR\cdot A+CaRR\cdot B \quad (4)$$

In this case, since the sound image signal that has the sound image to be localized at the center has the equal amplitude difference and the time difference at the right and left channels, it is considerable that the sound image signal A=the sound image signal B, and thus the formulae (1) and (2) in the expected listening environment can be expressed as the following formula (5), while the formulae (3) and (4) in the actual listening environment can be expressed as the following formula (6). Note that it is assumed that the sound receiving point is located on a line which interests at right angle with a line segment interconnecting the pair of speakers, and which passes through the mid-point of the line segment.

$$DeL=DeR=(CeLL+CeRL)\cdot A \quad (5)$$

$$DaL=DaR=(CaLL+CaRL)\cdot A \quad (6)$$

The sound processing device reproduces the tone expressed by the formula (5) when each sound image signal localized at the center is listened at the sound receiving point in the actual listening environment. That is, the equalizer EQ2 has a transfer function H1 expressed by the following formula (7), and applies this function to the sound image signal A to be localized at the center. Next, the equalizer EQ2 equally inputs the sound image signal A to which the transfer function H1 has been applied to both adders 10, 20.

$$H1=DeL/DaL=(CeLL+CeRL)/(CaLL+CaRL) \quad (7)$$

Next, the sound image signal that has the sound image to be localized at the front side of the left speaker is output by the left speaker SeL and the left speaker SaL only in the expected listening environment and in the actual listening environment. In this case, the sound wave signal DeL, the sound wave signal DaL to be listened by the left ear in the expected listening environment and in the actual listening environment, and, the sound wave signal DeR and the sound wave signal DaR to be listened by the right ear in the expected listening environment and in the actual listening environment become the following formulae (8) to (11), respectively.

$$DeL=CeLL\cdot A \quad (8)$$

$$DeR=CeLR\cdot A \quad (9)$$

$$DaL=CaLL\cdot A \quad (10)$$

$$DaR=CaLR\cdot A \quad (11)$$

The sound processing device reproduces the tone expressed by the formulae (8) and (9) when the sound image signal that has the sound image to be localized at the front side of the left speaker SeL is listened at the sound receiving point in the actual listening environment. That is, the equalizer EQ1 applies a transfer function H2 expressed by the following formula (12) to the sound image signal A to be listened by the left ear, and applies a transfer function H3 expressed by the following formula (13) to the sound image signal A to be listened by the right ear.

$$H2=DeL/DaL=CeLL/CaLL \quad (12)$$

$$H3=DeR/DaR=CeLR/CaLR \quad (13)$$

The equalizer EQ1 that processes the sound image signal which has the sound image to be localized at the front side of the left speaker has such transfer functions H2 and H3, applies the transfer functions H2 and H3 to the sound image signal A at a constant rate $\alpha$ ($0\leq\alpha\leq1$), and inputs the sound image signal A to the adder 10 that generates the left-channel sound signal. In other words, this equalizer EQ1 has a transfer function H4 expressed by the following formula (14).

$$H4=H2\quad\alpha+H3\cdot(1-\alpha) \quad (14)$$

Next, the sound image signal that has the sound image to be localized at the front side of the right speaker is output by the right speaker SeR and the right speaker SaR only in the expected listening environment and in the actual listening environment. In this case, the sound wave signal DeL, the sound wave signal DaL to be listened by the left ear in the expected listening environment and in the actual listening environment, and, the sound wave signal DeR and the sound wave signal DaR to be listened by the right ear in the expected listening environment and in the actual listening environment become the following formulae (15) to (18), respectively.

$$DeL=CeRL\cdot B \quad (15)$$

$$DeR=CeRR\cdot B \quad (16)$$

$$DaL=CaRL\cdot B \quad (17)$$

$$DaR=CaRR\cdot B \quad (18)$$

The sound processing device reproduces the tone expressed by the formulae (15) and (16) when the sound image signal that has the sound image to be localized at the front side of the right speaker SeR is listened at the sound receiving point in the actual listening environment. That is, the equalizer EQ3 applies a transfer function H5 expressed by the following formula (19) to the sound image signal B to be listened by the left ear, and applies a transfer function H6 expressed by the following formula (20) to the sound image signal B to be listened by the right ear.

$$H5=DeL/DaL=CeRL/CaRL \quad (19)$$

$$H6=DeR/Dar=CeRR/CaRR \quad (20)$$

The equalizer EQ3 that processes the sound image signal which has the sound image to be localized at the front side of the right speaker has such transfer functions H5 and H6, applies the transfer functions H5 and H6 to the sound image signal B at the constant rate $\alpha$ ($0\leq\alpha\leq1$), and inputs the sound image signal B to the adder 20 that generates the right-channel sound signal. In other words, this equalizer EQ3 has a transfer function H7 expressed by the following formula (21).

$$H7=H6\cdot\alpha+H5\cdot(1-\alpha) \quad (21)$$

Figure 3A:
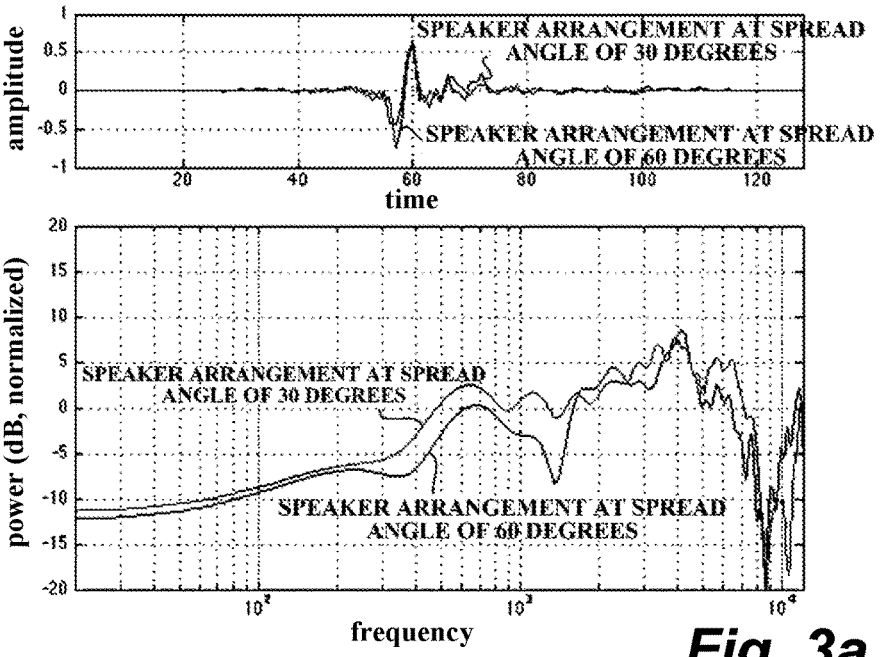
FIGS. 3A and 3B are graphs showing an analysis result of an impulse response in a time domain and in a frequency domain for each speaker setting and each sound localization direction.
Figure 3B:
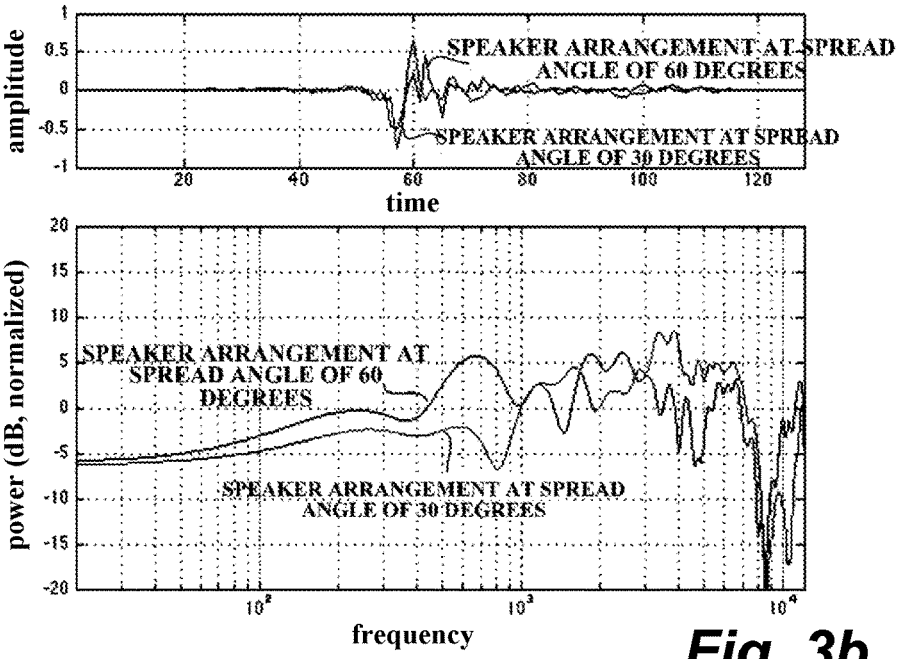

The inventors of the present disclosure measured the impulse response to the left ear from a speaker setting which had a spread angle of 30 degrees, and a speaker setting which had a spread angle of 60 degrees for the sound image signal with the sound image localized at the front side of the left speaker, and calculated the head-related transfer function. FIG. 3A shows the analysis results in the consequent time domain and frequency domain. In addition, the sound localization position of the sound image signal was changed to the center, and the impulse response was likely recorded. FIG. 3B shows the analysis results in the consequent time domain and frequency domain. In FIGS. 3A and 3B, the upper part represents the time domain, while the lower part represents the frequency domain.

As shown in FIGS. 3A and 3B, regardless of the sound localization direction, the frequency characteristic of the impulse response was changed in accordance with a change in the speaker setting. In addition, as is clear from the difference between FIG. 3A and FIG. 3B, how the frequency characteristic changes entirely differs in accordance with the sound localization direction.

Conversely, the sound processing device according to the first embodiment includes the three types of equalizers EQ1, EQ2, and EQ3 unique to the respective sound image signals that have the sound images to be localized at the center, the front side of the left speaker SaL, and the front side of the right speaker SaR. The equalizer EQ2 in which the sound image signal with the sound image to be localized at the center is input applies the transfer function H1 to the sound image signal. In addition, the equalizer EQ1 in which the sound image signal with the sound image to be localized at the front side of the left speaker SaL is input applies the transfer function H4 to the sound image signal. Still further, the equalizer EQ3 in which the sound image signal with the sound image to be localized at the front side of the right speaker SaR is input applies the transfer function H7 to the sound image signal.

Next, the equalizer EQ2 in which the sound image signal with the sound image to be localized at the center is input equally supplies the sound image signal to which the transfer function H1 has been applied into the adder 10 that generates the sound signal to be output by the left speaker SaL, and the adder 20 that generates the sound signal to be output by the right speaker SaR.

The equalizer EQ1 in which the sound image signal with the sound image to be localized at the front side of the left speaker SaL is input supplies the sound image signal to which the transfer function H4 has been applied into the adder 10 that generates the sound signal to be output by the left speaker SaL. In addition, the equalizer EQ3 in which the sound image signal with the sound image to be localized at the front side of the right speaker SaR is input supplies the sound image signal to which the transfer function H7 has been applied into the adder 20 that generates the sound signal to be output by the right speaker SaR.

As explained above, the sound processing device of this embodiment corrects the difference in tone to be listened in different environments, and includes the equalizers EQ1, EQ2, and EQ3 that tune the frequency characteristic so that a frequency characteristic of a sound wave listened in the second environment replicates the frequency characteristic of the same sound wave listened in the first environment. The plurality of equalizers EQ1, EQ2, and EQ3 is provided so as to correspond to the plurality of sound image signals that have the respective sound images to be localized in the different directions, and perform the unique frequency characteristic changing process on each corresponding sound image signal.

Hence, for each sound image signal that has a different frequency characteristic change in accordance with the sound localization direction, the unique equalizer process is performed to cancel the unique change to the frequency characteristic. Accordingly, the optimized tone correction is performed on each sound signal, and regardless of the sound localization direction of the sound wave to be output, the actual listening environment is excellently replicated by the expected listening environment.

[Second Embodiment]

A sound processing device according to a second embodiment will be explained in detail with reference to the figures. The sound processing device according to the second embodiment has a generalized tone correcting process for each sound image, and performs a unique tone correcting process to the sound image signal that has an arbitrary sound localization direction.

Figure 4:
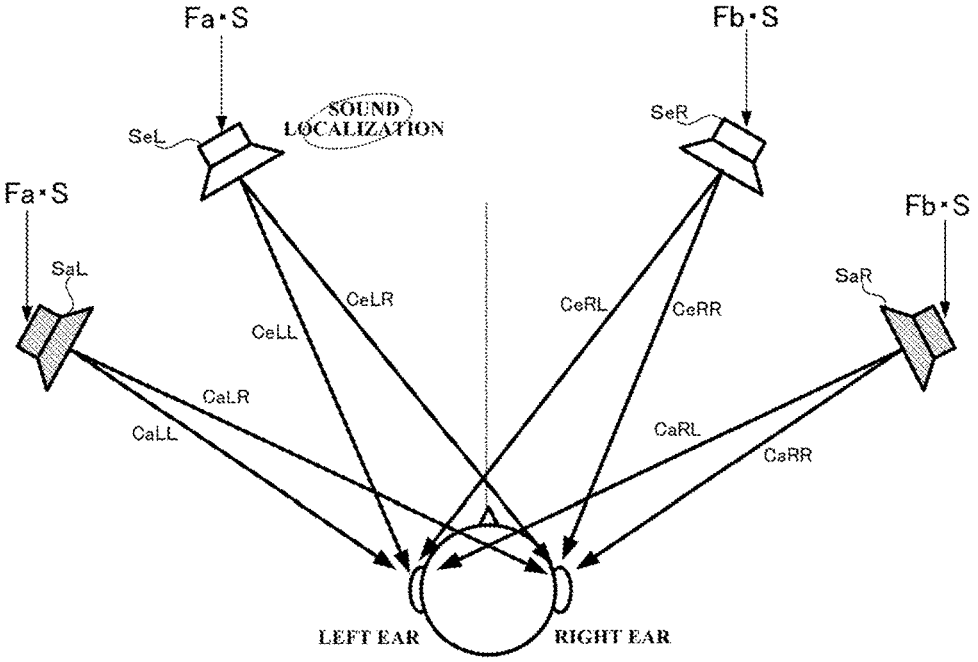
FIG. 4 is an exemplary diagram illustrating an expected listening environment, an actual listening environment, and a sound localization direction according to a second embodiment.

As illustrated in FIG. 4, in the expected listening environment, it is assumed that a transfer function of a frequency change given by a transfer path from a left speaker SeL to the left ear is CeLL, a transfer function of a frequency change given by a transfer path from the left speaker SeL to the right ear is CeLR, a transfer function of a frequency change given by a transfer path from a right speaker SeR to the left ear is CeRL, and a transfer function of a frequency change given by a transfer path from the right speaker SeR to the right ear is CeRR.

At this time, a sound image signal S that has the sound image to be localized in the predetermined direction becomes, in the expected listening environment, a sound wave signal SeL expressed by the following formula (22), and is listened by the left ear of the user, and also becomes a sound wave signal SeR expressed by the following formula (23), and is listened by the right ear of the user. In the formulae, terms Fa and Fb are transfer functions for respective channels which change the amplitude and delay difference of the sound image signal to obtain the sound localization in the predetermined direction. The transfer function Fa is applied to the sound signal S to be output by the left speaker SeL, while the transfer function Fb is applied to the sound signal S to be output by the left speaker SeL.

$$SeL=CeLL\cdot Fa\cdot S+CeRL\cdot Fb\cdot S \tag{22}$$

$$SeR=CeLR\cdot Fa\cdot S+CeRR\cdot Fb\cdot S \tag{23}$$

In addition, it is assumed that, in the actual listening environment, a transfer function of a frequency change given by a transfer path from a left speaker SaL to the left ear is CaLL, a transfer function of a frequency change given by a transfer path from the left speaker SaL to the right ear is CaLR, a transfer function of a frequency change given by a transfer path from a right speaker SaR to the left ear is CaRL, and a transfer function of a frequency change given by a transfer path from the right speaker SaR to the right ear is CaRR. Still further, it is assumed that the sound image signal A is output by the left speaker SaL, while the sound image signal B is output by the right speaker SaR.

At this time, the sound image signal S that has the sound image to be localized in the predetermined direction becomes, in the expected listening environment, the sound wave signal SaL of the following formula (24) and is listened by the left ear of the user, and also becomes the sound wave signal SaR of the following formula (25) and is listened by the right ear of the user.

$$SaL=CaLL\cdot Fa\cdot S+CaRL\cdot Fb\cdot S \tag{24}$$

$$SaR=CaLR\cdot Fa\cdot S+CaRR\cdot Fb\cdot S \tag{25}$$

The formulae (22) to (25) are generalized formulae of the above formulae (1) to (4), (8) to (11), and (15) to (18). As for the sound image signal that has the sound image to be localized at the center, the transfer function Fa=the transfer function Fb, and the formulae (22) to (25) become the formulae (1) to (4), respectively. As for the sound image signal that has the sound image to be localized at the front side of the left speaker, the transfer function Fb=0, and the formulae (22) to (25) become the formulae (8) to (11). As for the sound image signal that has the sound image to be localized at the front side of the right speaker, the transfer function Fa=0, and the formulae (22) to (25) become the formulae (15) to (18).

In this case, when transfer functions H8 and H9 expressed by the following formulae (26) and (27) are applied to the formulae (24) and (25), respectively, those formulae become consistent with the formulae (23) and (24), respectively.

$$H8=SeL/SaL=(CeLL\cdot Fa+CeRL\cdot Fb)/(CaLL\cdot Fa+CaRL\cdot Fb) \quad (26)$$

$$H9=SeR/SaR=(CeLR\cdot Fa+CeRR\cdot Fb)/(CaLR\cdot Fa+CaRR\cdot Fb) \quad (27)$$

When the transfer function H8 is applied to the formula (24), the transfer function H9 is applied to the formula (25), and the signals are coordinated into a sound image signal Fa·S in the channel corresponding to the left speaker SaL and a sound image signal Fb·S in the channel corresponding to the right speaker SaR, a transfer function H10 expressed by the following formula (28) and applied to the sound image signal in the channel corresponding to the left speaker SaL is derived, and a transfer function H11 expressed by the following formula (29) and applied to the sound image signal in the channel corresponding to the right speaker SaR is also derived. The symbol α in the formulae is a weighting coefficient, and is a value ($0 \leq \alpha \leq 1$) that determines the similarity level of the transfer function at the ear close to the sound image in the actual listening environment to the transfer function at the ear in the head-related transfer function of the right and left ears that perceive the sound image in the expected sound field.

$$H10=H8\cdot\alpha+H9\cdot(1-\alpha) \quad (28)$$

$$H11=H8\cdot(1-\alpha)+H9\cdot\alpha \quad (29)$$

Figure 5:
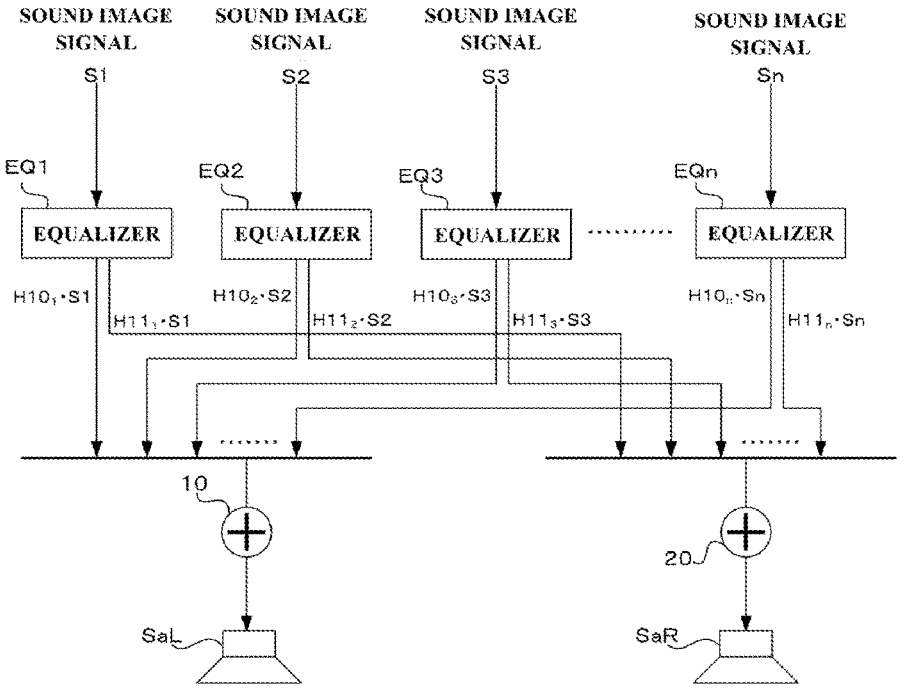
FIG. 5 is a block diagram illustrating a structure of a sound processing device according to the second embodiment.

FIG. 5 is a structural diagram illustrating the structure of a sound processing device in view of the forgoing. As illustrated in FIG. 5, the sound processing device includes equalizers EQ1, EQ2, EQ3, . . . and EQn corresponding to sound image signals S1, S2, S3, . . . and Sn, respectively, and adders 10, 20, . . . etc., corresponding to the number of channels are provided at the subsequent stage of the equalizers EQ1, EQ2, EQ3, and EQn. Each equalizer EQ1, EQ2, EQ3, . . . and EQn has transfer functions H$\mathbf{10}_i$ and H$\mathbf{11}_i$ based on the transfer functions H10 and H11, and identified by the transfer functions Fa and Fb that give the amplitude difference and the time difference to the sound image signals S1, S2, S3, . . . and Sn to be processed.

When a sound image signal Si is input, the equalizer EQi applies the transfer functions H$\mathbf{10}_i$ and H$\mathbf{11}_i$ to the sound image signal Si which are unique thereto, inputs a sound image signal H$\mathbf{10}_i$·Si to the adder 10 of the channel corresponding to the left speaker SaL, and inputs a sound image signal H$\mathbf{11}_i$·Si to the adder 20 of the channel corresponding to the right speaker SaR.

The adder 10 connected to the left speaker SaL adds the sound image signals H$\mathbf{10}_1$·S1, H$\mathbf{10}_2$·S2, . . . and H$\mathbf{10}_n$·Sn, and generates the sound signal to be output by the left speaker SaL, and may output this signal thereto. The adder 20 connected to the right speaker SaR adds the sound image signals H$\mathbf{11}_1$·S1, H$\mathbf{11}_2$·S2, . . . and H$\mathbf{11}_n$·Sn, and generates the sound signal to be output by the right speaker SaR, and may output this signal thereto.

[Third Embodiment]

Figure 6:
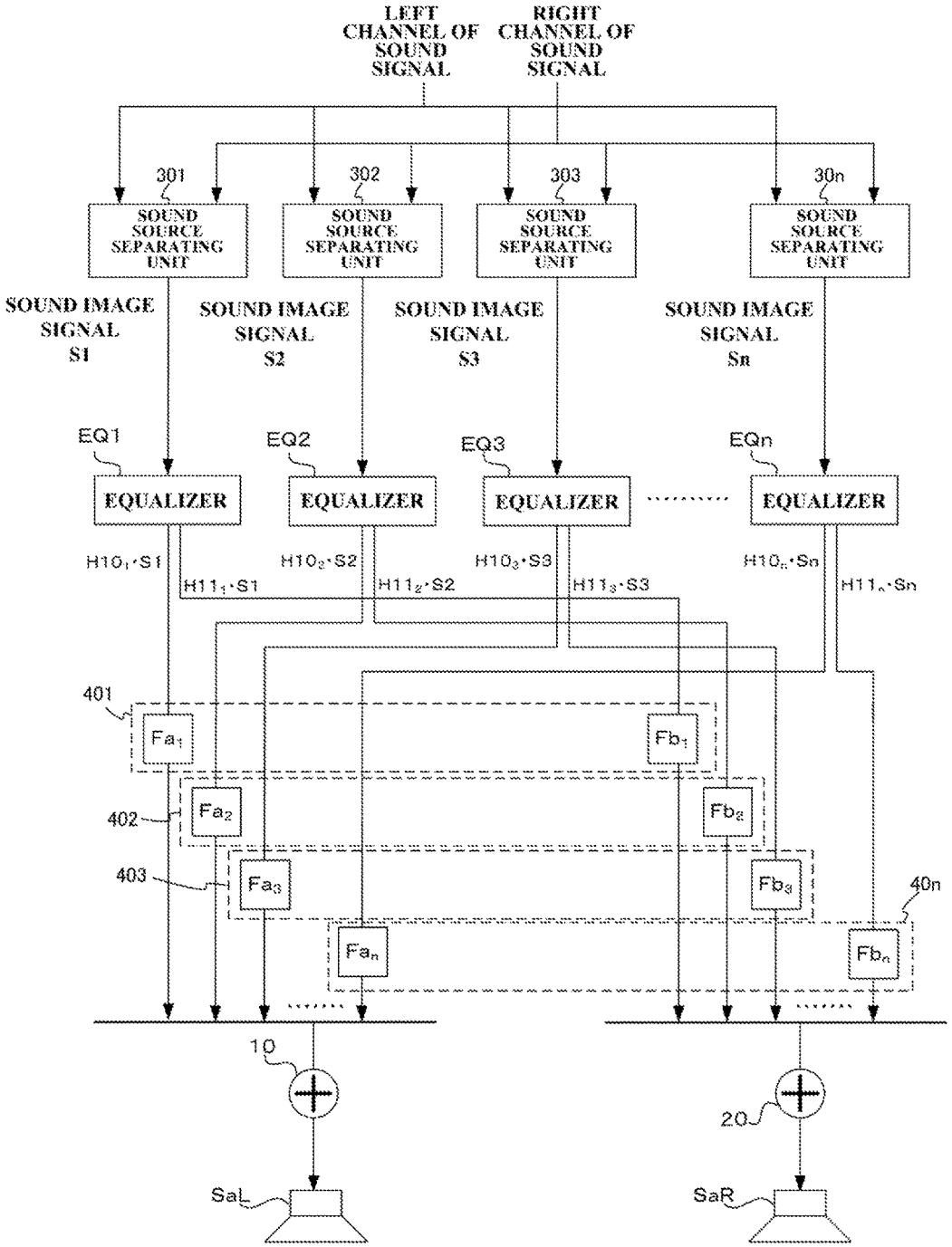
FIG. 6 is a block diagram illustrating a structure of a sound processing device according to a third embodiment.

As illustrated in FIG. 6, a sound processing device according to a third embodiment includes, in addition to the equalizers EQ1, EQ2, EQ3, . . . and EQn of the first and second embodiments, sound source separating units 30*i* and sound localization setting units 40*i*.

Input to the sound source separating units 30*i* are sound signals in a plurality of channels, and the sound image signal in each sound localization direction is subjected to sound source separation from this sound image. The sound image signal having undergone the sound source separation by the sound source separating unit 30*i* is input to each equalizer. Various schemes including conventionally well-known schemes are applicable as the sound source separation method.

As for the sound source separation method, for example, an amplitude difference and a phase difference between channels may be analyzed, a difference in the waveform structure may be detected by statistical analysis, frequency analysis, complex number analysis, etc., and the sound image signal in a specific frequency band may be emphasized based on the detection result. By making a plurality of settings while shifting the specific frequency band, the sound image signals in respective directions are separable.

The sound localization setting unit 40*i* is provided between each equalizer EQ1, EQ2, EQ3, . . . and EQn, and each adder 10, 20, etc. , and sets up again the sound localization direction for the sound image signal. The sound localization setting unit 40*i* includes a filter that applies a transfer function Fai (where i=1, 2, 3, . . . and n) to the sound image signal to be output by the left speaker SaL, and also includes a filter that applies a transfer function Fbi (where i=1, 2, 3, . . . and n) to the sound image signal to be output by the right speaker SaR. Those transfer functions Fai and Fbi are also reflected on the transfer functions H8 and H9 in the formulae (26) and (27), respectively.

The filter includes, for example, a gain circuit and a delay circuit. The filter changes the sound image signal so as to have the amplitude difference and the time difference indicated by the transfer functions Fai and Fbi between the channels. The single equalizer EQi is connected to the pair of filters, and the transfer functions Fai and Fbi of those filters give a new sound localization direction to the sound image signal.

Figure 7:
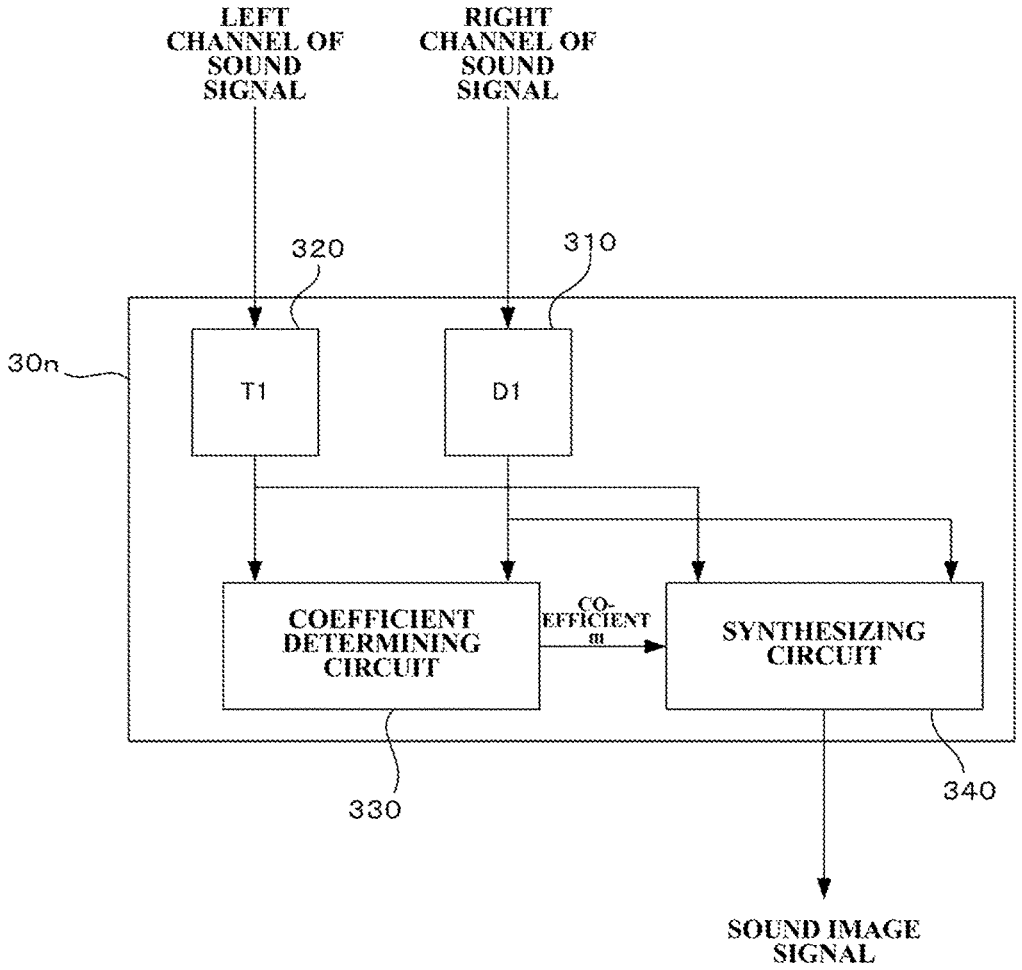
FIG. 7 is a block diagram illustrating a sound source separating unit according to the third embodiment.

An example sound source separating unit 30*i* will be explained below. FIG. 7 is a block diagram illustrating a structure of a sound source separating unit. The sound processing device includes a plurality of sound source separating units 301, 302, 303, . . . and 30*n*. Each sound source separating unit 30*i* extracts each specific sound image signal from the sound signal. The extraction method of the sound image signal is to relatively emphasize the sound image signal that has no phase difference between the channels, and to relatively suppress the other sound image signals. As for each sound image signal contained in the sound signal, a delay that causes the phase difference of the specific sound signal between the channels to be zero is uniformly applied, thereby accomplishing the consistent phase difference between the channels for the specific sound image signal only. Each sound source separating unit has a different delay level, and thus the sound image signal in each sound localization direction is extracted.

The sound source separating unit 30*i* includes a first filter 310 for the one-channel sound signal, and a second filter 320 for the other-channel sound signal. In addition, the sound source separating unit 30*i* includes a coefficient determining circuit 330 and a synthesizing circuit 340 into which the signals through the first filter 310 and the second filter 320 are input, and which are connected in parallel.

The first filter 310 includes an LC circuit, etc., gives a constant delay to the one-channel sound signal, thereby making the one-channel sound signal always delayed relative to the other-channel sound signal. That is, the first filter gives a delay that is longer than a time difference set between the channels for the sound localization. Hence, all sound image components contained in the other-channel sound signal are advanced relative to all sound image components contained in the one-channel sound signal.

The second filter 320 includes, for example, an FIR filter or an IIR filter. This second filter 320 has a transfer function T1 that is expressed by the following formula (30). In the formula, the terms CeL and CeR are transfer functions given to the sound wave from the transfer path in the expected listening environment, and such a transfer path is from the sound image position of the extracted sound image signal by the sound source separating unit to the sound receiving point. CeL is for the transfer path from the sound image position to the left ear, while CeR is for the transfer path from the sound image position to the right ear.

$$CeR \cdot T1 = CeL \tag{30}$$

The second filter 320 has the transfer function T1 that satisfies the formula (30), tunes the sound image signal to be localized in the specific direction to have the same amplitude and the same phase, but adds the time difference in such a way that the farther from the specific direction the sound image signal to be localized in the direction other than that specific direction becomes, the more the applied time difference becomes.

The coefficient determining circuit 330 calculates an error between the one-channel sound signal and the other-channel sound signal, thereby determining a coefficient m(k) in accordance with the error.

In this case, an error signal e(k) of the sound signals simultaneously arriving the coefficient determining circuit 330 is defined as the following formula (31). In the formula, the term A(k) is the one-channel sound signal, while the term B(k) is the other-channel sound signal.

$$e(k) = A(k) - m(k-1) \cdot B(k) \tag{31}$$

The coefficient determining circuit 330 sets the error signal e(k) as a function of a coefficient m(k−1), and calculates an adjacent-two-term recurrence formula of a coefficient m(k) containing the error signal e(k), thereby searching the value of the coefficient m(k) that minimizes the error signal e(k). Through this arithmetic process, the coefficient determining circuit 330 updates the coefficient m(k) in such away that the larger the time difference caused between the channels in the sound signals is, the more the coefficient m(k) is decreased, and outputs the coefficient m(k) set to be closer to 1 when there is no time difference.

The following formula (32) expresses an example adjacent-two-term recurrence formula.

$$m(k) = m(k-1) \times \beta + \partial E(m)^2 / \partial m \tag{32}$$

However, $\partial E(m)^2 / \partial m = \mu \times e(k) \times A(k)$

Input to the synthesizing circuit 340 are the coefficient m(k) from the coefficient determining circuit 330 and the sound signals in the both channels. The synthesizing circuit 340 may multiply the sound signals in the both channels by the coefficient m(k) at an arbitrary rate, add the sound signals at an arbitrary rate, and may output a consequent specific sound image signal.

[Other Embodiments]

Certain embodiments of the present disclosure have been explained in this specification, but such embodiments are merely presented as examples, and are not intended to limit the scope of the present disclosure. A combination of some of or all of the features disclosed in the embodiments is also within the scope of the present disclosure. The above embodiments can be carried out in other various forms, and various omissions, replacements, and modifications can be made thereto without departing from the scope of the present disclosure. Such embodiments and modified forms thereof are within the scope and spirit of the present disclosure, and also within the scope of the invention as recited in the appended claims and the equivalent range thereto.

For example, an outputter in the actual listening environment is expected in various forms, such as a vibration source that generates sound waves, a head-phone, and an ear-phone. In addition, the sound signal may be derived from an actual sound source or a virtual sound source, and the actual sound source and the virtual sound source may have different number of sound sources. This can be coped with the arbitrary number of sound image signals separated and extracted as needed.

In addition, the sound processing device may be realized as a software process executed by a CPU, a DSP, etc. , or may be realized by special-purpose digital circuits. When the sound processing device is realized as the software process, in a computer that includes a CPU, an external memory, and a RAM, a program that describes the same process details as those of the equalizers EQi, the sound source separating units 30*i*, and the sound localization setting units 40*i* may be stored in the external memory, such as a ROM, a hard disk, or a flash memory, extracted as needed in the RAM, and the CPU may execute the arithmetic process in accordance with the extracted program.

This program may be stored in a non-transitory memory medium, such as a CD-ROM, a DVD-ROM, or a server device, and may be installed by loading a medium in a drive or downloading via a network.

Still further, the speaker setting connected to the sound processing device may include equal to or greater than two speakers, such as stereo speakers or 5.1-ch. speakers, and the equalizer EQi may have a transfer function in accordance with the transfer path of each speaker, and a transfer function that has the amplitude difference and the time difference between the channels taken into consideration. Each equalizer EQ1, EQ2, EQ3, . . . and EQn may have a plural types of transfer functions in accordance with several forms of the speaker setting, and the transfer function to be applied may be selected by a user in accordance with the speaker setting.

REFERENCE SIGNS LIST

EQ1, EQ2, EQ3, . . . EQn Equalizer
10, 20 Adder
301, 302, 303, . . . 30*n* Sound source separating unit
310 First filter
320 Second filter
330 Coefficient determining circuit
340 Synthesizing circuit
401, 402, 403, . . . 40*n* Sound localization setting unit
SaL Speaker
SaR Speaker

The invention claimed is:

1. A sound processing device that corrects a tone sound-localized to, and listened in, an actual speaker location environment to replicate a tone sound-localized to, and listened in, an expected speaker location environment, the device comprising:

a plurality of equalizers, each said equalizer tuning a frequency characteristic so that a frequency characteristic of a sound wave listened to in the actual speaker location environment replicates a frequency characteristic of the same sound wave listened to in the expected speaker location environment by applying a transfer function Se/Sa to a sound signal, where a transfer function of a frequency change of the actual speaker location environment affecting the sound wave is Sa and a transfer function of a frequency change of the expected speaker location environment affecting the sound wave is Se, and where the transfer function Se/Sa is a synthesized transfer function of the transfer function Se and the transfer function Sa, wherein the plurality of equalizers are provided corresponding to a plurality of sound image signals that have respective sound images to be localized in different directions, each of the plurality of equalizers performing a unique frequency characteristic changing process to the corresponding sound image signal, wherein the transfer function Sa is CaF, which is a multiplication of a head-related transfer function Ca from a first speaker to a receiver in the actual speaker location environment and a transfer function F to sound-localize the sound signal, and wherein the transfer function Se is CeF, which is a multiplication of a head-related transfer function Ce from a second speaker to a receiver in the expected speaker location environment and the transfer function F to sound-localize the sound signal.

2. The sound processing device according to claim 1, wherein each of the equalizers has a unique transfer function to each sound localization direction, and applies the unique transfer function to the corresponding sound image signal.

3. The sound processing device according to claim 2, wherein the transfer function of each said equalizer is based on both of the head-related transfer functions of the sound wave reaching each ear in the expected speaker location environment and also the head-related transfer functions of the sound wave reaching each ear in the actual speaker location environment.

4. The sound processing device according to claim 2, wherein the transfer function of each said equalizer is based on a difference between channels created to cause the sound image of the corresponding sound image signal to be localized.

5. The sound processing device according to claim 4, wherein the difference between the channels is an amplitude difference, a time difference or both applied between the channels in accordance with the sound localization direction at the time of signal outputting.

6. The sound processing device according to claim 4, further comprising a sound localization setting filter giving the difference between the channels to cause the sound image of the sound image signal to be localized, wherein the transfer function of each said equalizer is based on the difference given by the sound localization setting filter.

7. The sound processing device according to claim 1, further comprising at least one sound source separating processor separating each sound image component from a sound signal containing a plurality of sound image components with different sound localization directions to generate each of the sound image signals, wherein each said equalizer performs the unique frequency characteristic changing process to the sound image signal generated by the at least one sound source separating processor.

8. The sound processing device according to claim 7, wherein:

the at least one sound source separating processor comprising a plurality of sound source separating processors provided corresponding to each of the sound image components; and each of the sound source separating processors comprises:

a filter giving a specific time of delay to a first channel of the sound signal, and tuning the corresponding sound image components to have a same amplitude and a same phase;

a coefficient determining circuit multiplying the first channel of the sound signal by a coefficient m to generate an error signal between the channels, and calculating a recurrence formula of the coefficient m containing the error signal; and a synthesizing circuit multiplying the sound signal by the coefficient m.

9. A sound processing method of correcting a difference in tone heard in different environments, the method comprising a tuning step of tuning a frequency characteristic so that a frequency characteristic of sound wave heard in an actual speaker location environment replicates a frequency characteristic of the same sound wave heard in an expected speaker location environment by applying a transfer function Se/Sa to a sound signal, where a transfer function of a frequency change of the actual speaker location environment affecting the sound wave is Sa and a transfer function of a frequency change of the expected speaker location environment affecting the sound wave is Se, and where the transfer function Se/Sa is a synthesized transfer function of the transfer function Se and the transfer function Sa, wherein the transfer function Sa is CaF, which is a multiplication of a head-related transfer function Ca from a first speaker to a receiver in the actual speaker location environment and a transfer function F to sound-localize the sound signal, wherein the transfer function Se is CeF, which is a multiplication of a head-related transfer function Ce from a second speaker to a receiver in the expected speaker location environment and the transfer function F to sound-localize the sound signal, and wherein the tuning step is performed uniquely to a plurality of sound image signals that have respective sound images to be localized in different directions, and a unique frequency characteristic changing process to the corresponding sound image signal is performed thereon.

10. A non-transitory computer accessible medium storing a program that causes a computer to execute a sound process of correcting a difference in tone heard in different environments, the process comprising:

a tuning step of tuning a frequency characteristic so that a frequency characteristic of sound wave heard in an actual speaker location environment replicates a frequency characteristic of the same sound wave heard in an expected speaker location environment by applying a transfer function Se/Sa to a sound signal, where a transfer function of a frequency change of the actual speaker location environment affecting the sound wave is Sa and a transfer function of a frequency change of the expected speaker location environment affecting the sound wave is Se, and where the transfer function Se/Sa is a synthesized transfer function of the transfer function Se and the transfer function Sa, wherein the transfer function Sa is CaF, which is a multiplication of a head-related transfer function Ca from a first speaker to a receiver in the actual speaker location environment and a transfer function F to sound-localize the sound signal, wherein the transfer function Se is CeF, which is a multiplication of a head-related transfer function Ce from a second speaker to a receiver in the expected speaker location environment and the transfer function F to sound-localize the sound signal, and wherein the tuning step is performed uniquely to a plurality of sound image signals that have respective sound images to be localized in different directions, and a unique frequency characteristic changing process to the corresponding sound image signal is performed thereon.

11. The computer accessible medium storing according to claim 10, wherein the unique frequency characteristic changing process comprises applying a unique transfer function of each sound localization direction to the corresponding sound image signal.

12. The computer accessible medium storing according to claim 11, wherein the unique transfer function is based on each head-related transfer function of the sound wave reaching each ear in the expected speaker location environment and in the actual speaker location environment.

13. The computer accessible medium storing according to claim 11, wherein the unique transfer function is based on a difference between channels created to cause the sound image of the corresponding sound image signal to be localized.

14. The computer accessible medium storing according to claim 13, wherein the difference between the channels is an amplitude difference, a time difference or both applied between the channels in accordance with the sound localization direction at the time of signal outputting.

15. The computer accessible medium storing according to claim 13, wherein:

the process furthermore comprises a sound localization setting step of giving the difference between the channels to cause the sound image of the sound image signal to be localized;

the unique transfer function is based on the difference obtained in the sound localization setting step.

16. The computer accessible medium storing according to claim 10, wherein:

the process furthermore comprises a sound source separating step of separating each sound image component from a sound signal containing a plurality of sound image components with different sound localization directions to generate each of the sound image signals; and the unique frequency characteristic changing process is performed to the sound image signal generated by the sound source separating step.

17. The computer accessible medium storing according to claim 16, wherein:

the sound source separating step is performed multiple times so as to correspond to each of the sound image components; and the sound source separating step comprises:

a filtering step of giving a specific time of delay to a first channel of the sound signal, and tuning the corresponding sound image components to have a same amplitude and a same phase;

a coefficient determining step of multiplying the first channel of the sound signal by a coefficient m to generate an error signal between the channels, and calculating a recurrence formula of the coefficient m containing the error signal; and a synthesizing step of multiplying the sound signal by the coefficient m.

* * * * *